United States Patent [19]

Wheatley

[11] Patent Number: 4,494,488

[45] Date of Patent: Jan. 22, 1985

[54] FUEL CHARGING SYSTEM FOR HIGH PERFORMANCE VEHICLES

[75] Inventor: William M. Wheatley, Columbia, S.C.

[73] Assignee: Ram Automotive Company, Canton, Ohio

[21] Appl. No.: 613,219

[22] Filed: May 23, 1984

[51] Int. Cl.[3] ..... F02B 75/12

[52] U.S. Cl. ..... 123/1 A; 123/575; 123/585; 123/445

[58] Field of Search ..... 123/1 A, 575, 445, 585, 123/525

[56] References Cited

PUBLICATIONS

Superpower "Nitrous Oxide Injection" 1977, Pat Ganahl pp. 48–93.

Advertising brochure entitled "Nitrous Charging by ICE".

*Primary Examiner*—E. Rollins Cross

*Attorney, Agent, or Firm*—Michael Sand Co.

[57] ABSTRACT

A fuel charging system injects liquid nitrous oxide into the engine of a high performance vehicle to provide an instant burst of power to the vehicle. A supply cylinder of pressurized liquid nitrous oxide is connected by an outlet conduit to the vehicle engine. A cylinder of nitrogen gas under a considerably higher pressure than that of the nitrous oxide is connected to the nitrous oxide cylinder by an inlet conduit. The nitrogen gas inlet conduit and nitrous oxide outlet conduit are connected to the nitrous oxide cylinder by an adapter valve. The nitrogen gas passes through a pressure regulator located in the inlet conduit and maintains a high pressure blanket of gas above the nitrous oxide in the cylinder to force the nitrous oxide from the cylinder and into the engine at a constant and sustained rate eliminating the heretofore rapid drop in the supply pressure of the nitrous oxide as the supply of nitrous oxide is dissipated from the supply cylinder.

13 Claims, 3 Drawing Figures

FUEL CHARGING SYSTEM FOR HIGH PERFORMANCE VEHICLES

TECHNICAL FIELD

The invention relates to a fuel charging system and in particular to such a system for use with high performance vehicles such as racing vehicles. More particularly, the invention relates to such a fuel charging system which supplies liquid nitrous oxide to the engine at a constant predetermined pressure and amount to maintain a constant fuel-oxygen mixture for chemically supercharging the vehicle engine for a longer time duration than heretofore achieved.

BACKGROUND ART

The chemical supercharging of racing engines has been used for some time in the racing and high performance vehicle industry for applying a sudden burst of power to the vehicle engine for increased engine horsepower and torque. One type of chemical supercharging is accomplished with nitrous oxide which is a chemical compound of nitrogen and oxygen commonly known as an oxidizer. When nitrous oxide, which under pressure is in liquid form, is exposed to the heat of combustion it disassociates into its free elements of oxygen and nitrogen. When the nitrous oxide is injected into an internal combustion engine, it will create a very lean condition in the combustion chamber. This is alleviated by injecting additional fuel simultaneously with the nitrous oxide. When this is accomplished, the vehicle has an instant power gain and will deliver increased horsepower and torque to the engine. This will provide a sudden burst of power to the vehicle for use in the final stretch of a race or for passing another vehicle at a critical time in the race.

Heretofore, existing nitrous charging systems consist of a cylinder or container holding a supply of the nitrous oxide under pressure, for example, approximately 900 psi. The cylinder is connected by a conduit to the carburetor of the engine having a solenoid actuated valve in the conduit or supply line. The solenoid valve is operated by the driver from within the vehicle at the instant that the sudden burst of power is desired. However, the supply container of nitrous oxide must be relatively small to avoid increasing the weight of the racing vehicle and due to space limitations therein. This presents a serious problem in that the pressure of the nitrous oxide is rapidly dissipated upon opening of the solenoid valve by the driver. For example, if the nitrous oxide is maintained in a usual supply cylinder at a pressure of 900 psi, this pressure will drop to approximately 600 psi within three or four seconds upon the liquid nitrous oxide being supplied to the engine due to its closed environment within the cylinder. This rapid drop in pressure will affect the amount of nitrous oxide supplied to the carburetor resulting in an improper mixture of the oxygen which is released by the nitrous oxide with the fuel being simultaneously injected into the carburetor. This improper mixture results in inefficient and unsatisfactory performance of the engine. Thus, the most efficient charging of the engine occurs for only a relatively short period of time before the efficiency drops off considerably.

Therefore, the need exists for an improved system for charging a high performance vehicle particularly with liquid nitrous oxide, which will maintain a constant predetermined flow of the nitrous oxide for a longer duration of time than is presently possible with exisiting nitrous oxide cylinders without increasing materially the size and weight of the fuel charging system.

DISCLOSURE OF THE INVENTION

Objectives of the invention include providing an improved fuel charging system for high performance vehicles which enables a supply of nitrous oxide to be supplied under a predetermined constant pressure to the vehicle engine for a longer duration of time than heretofore possible with known nitrous oxide charging system without appreciably increasing the weight and size of the charging system. Another objective is to provide such a fuel charging system in which a supply of pressurized nitrogen gas is contained in a separate cylinder and is connected through a pressure regulator to the nitrous oxide cylinder by a unique adapter; and in which the nitrogen gas forms a pressurized blanket within the nitrous oxide cylinder to force the liquid nitrous oxide from its cylinder and through a delivery tube into a supply conduit which is connected to the vehicle engine.

Another objective is to provide such an improved fuel charging system in which the improved adapter enables commercially available nitrous oxide cylinders to be used in combination with readily available pressurized nitrogen gas cylinders thereby eliminating additional expense by requiring special supply cylinders of the nitrous oxide and nitrogen, and which enables usual pressure regulating and relief valves to be incorporated therein to provide an extremely safe and efficient system at a relatively low cost in contrast to existing charging systems. Still another objective is to provide such a system in which both the nitrogen cylinder and nitrous oxide cylinder are provided with usual manually operated valves for maintaining the cylinders in a sealed and safe condition until ready for use in the vehicle, and in which the actuation of the charging system is accomplished in the usual manner by remote controlled solenoid actuated valves.

These objectives and advantages are achieved by the improved fuel charging system of the invention which is intended for use with engines of high performance vehicles, the general nature of which may be stated as including a first container for holding a supply of pressurized liquid nitrous oxide; a second container for holding a supply of pressurized nitrogen gas, said nitrogen gas being under a greater pressure than the nitrous oxide; first conduit means for delivering nitrous oxide from the first container to the vehicle engine; second conduit means for delivering pressurized nitrogen gas from the second container into the first container to form a pressurized blanket of nitrogen gas against the liquid nitrous oxide for discharging the nitrous oxide from said first container and into the vehicle engine through the first conduit means; and valve means for directing the flow of pressurized nitrogen gas into the first container to form the pressurized blanket of nitrogen gas and for permitting the flow of nitrous oxide from said container and into the first conduit means.

BRIEF DESCRIPTION OF THE DRAWINGS

A preferred embodiment of the invention, illustrative of the best mode in which applicant has contemplated applying the principles, is set forth in the following description and is shown in the drawings, and is particularly and distinctly pointed out and set forth in the appended claims.

Similar numerals refer to similar parts throughout the drawings.

BEST MODE FOR CARRYING OUT THE INVENTION

Figure 1:
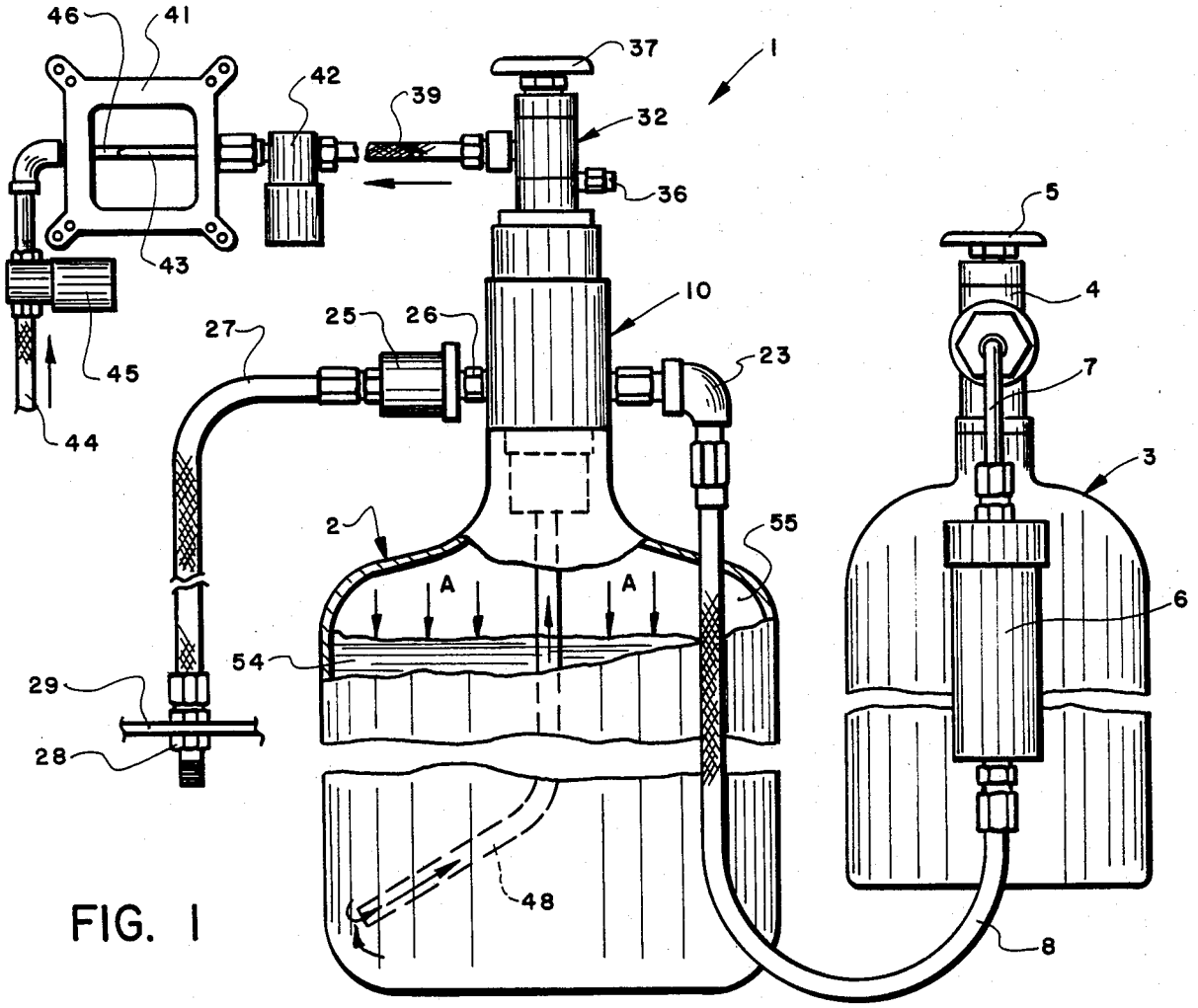
FIG. 1 is a diagrammatic perspective view of the main components of the improved fuel charging system shown connected to the spray bar of a base plate which will be located between a carburetor and intake manifold of an engine.
Figure 3:
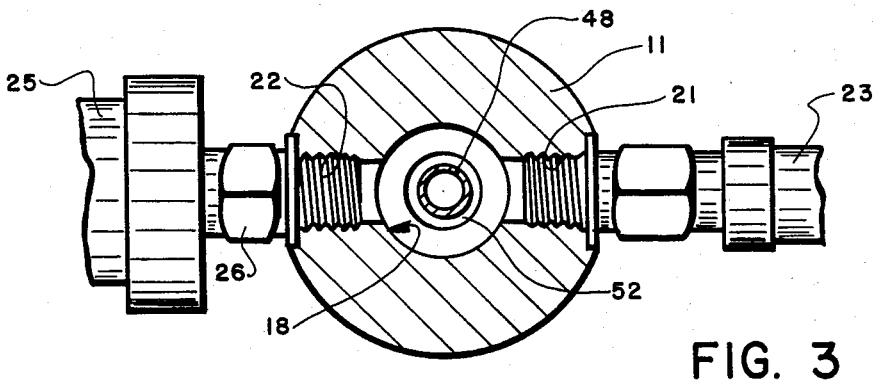
FIG. 3 is a fragmentary sectional view taken on line 3—3, FIG. 2.

The improved fuel charging system is indicated generally at 1, and is shown particularly in FIG. 1. System 1 includes a nitrous oxide supply cylinder or container indicated generally at 2, and a nitrogen supply cylinder or container indicated generally at 3. A usual manually controlled valve 4 is mounted in the top opening or neck of nitrogen cylinder 3 having a rotatable handle 5. A pressure regulator valve 6 is connected to valve 4 by a section of conduit 7 and is connected to nitrous oxide container 2 by a conduit 8. Conduit 8 is connected to cylinder 2 by an improved adapter indicated generally at 10.

Figure 2:
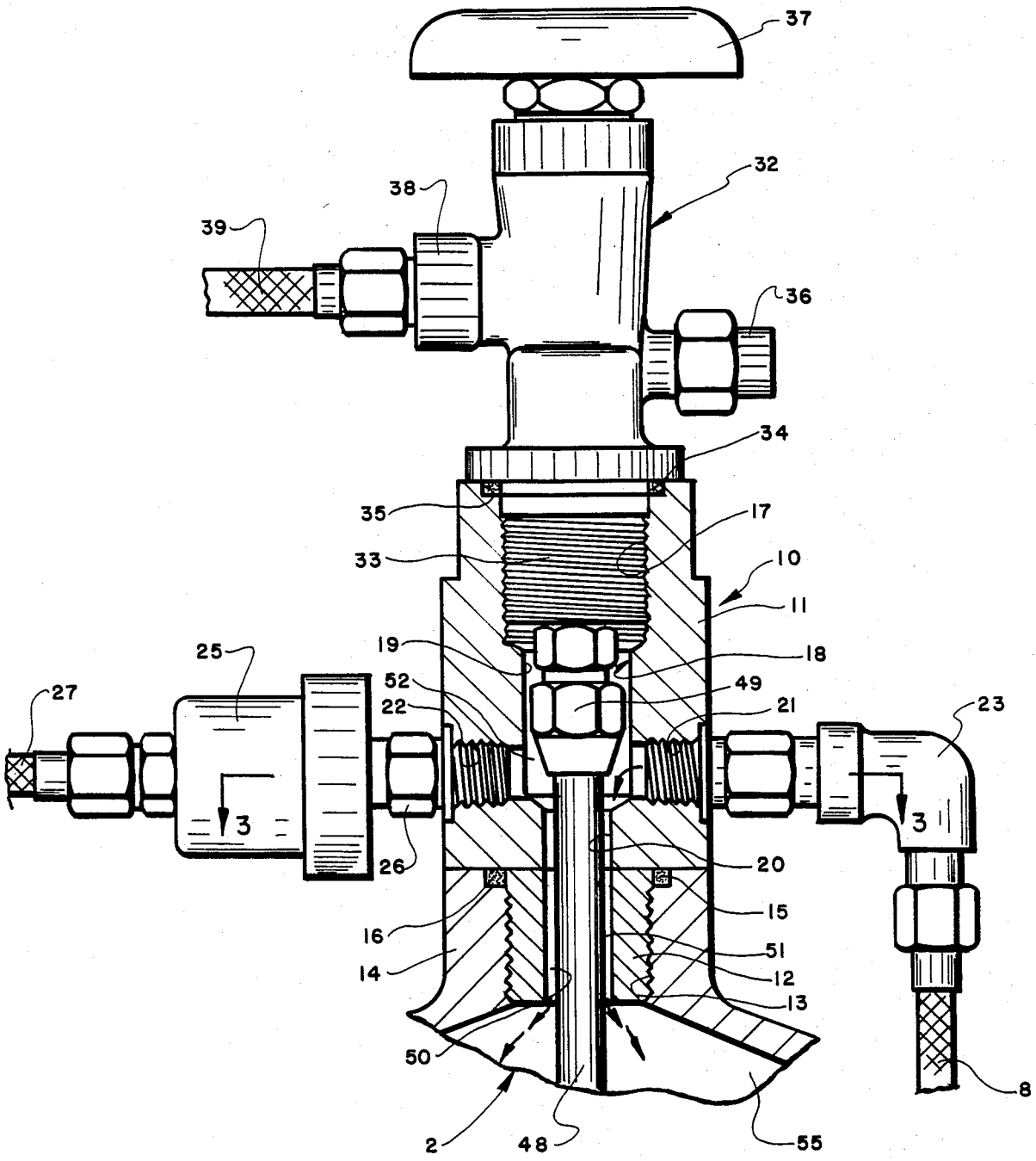
FIG. 2 is an enlarged fragmentary plan view with portions broken away and in section, of the improved adapter component of the system shown mounted on the neck of a nitrous oxide supply container.

Adapter 10 is shown particularly in FIG. 2 and includes a main cylindrical body 11 formed of brass or stainless steel, having an externally threaded reduced bottom end 12 which is threadably engaged within a threaded opening 13 formed in neck 14 of cylinder 2. A sealing gasket 15 preferably is mounted in a complementary shaped annular recess 16 formed in cylinder neck 14 adjacent opening 13.

The upper portion of adapter 10 is formed with an internally threaded bore portion 17 of a main axially extending bore indicated generally at 18, which extends throughout adapter 10. Axial bore 18 further includes a central portion 19 and a smaller diameter cylindrical lower portion 20 which extends from central portion 19 through externally threaded bottom end 12.

A pair of transversely extending secondary bores 21 and 22 are formed in adapter body 11 and communicate with main axial bore 18 at the central portion 19 thereof. Nitrogen gas supply conduit 8 is connected to secondary bore 21 by a coupling assembly 23. A pressure relief valve 25 is connected by a coupler 26 to the other secondary bore 22. A pressure relief line 27 is connected to relief valve 25 and has an overboard drain 28 at its opposite end which extends through a mounting wall 29 of the vehicle for safe discharge of the nitrous oxide contained in cylinder 2 in the event of an excess build up of pressure.

A usual manually actuated valve 32 is mounted in top threaded bore portion 17 of adapter 10 by a cylindrical threaded end portion 33 (FIG. 2). Threaded end 33 heretofore was intended to be threadably engaged within threaded opening 13 of cylinder 2. A sealing gasket 34 is seated in an annular-shaped recess 35 formed in the top end of adapter 10 to provide a fluid and airtight seal between valve 32 and adapter 10.

Valve 32 includes a usual pressure relief valve 36, a manually actuated handle 37 and a coupler 38 for connecting a nitrous oxide supply line 39 thereto. Supply line 39 is connected to a spray bar 43 mounted on a usual base plate 41 (FIG. 1) which is mounted in a usual manner between the carburetor and intake manifold (not shown) of a vehicle engine. A solenoid control valve 42 is mounted in nitrous oxide supply line 39. A fuel supply line 44 also is connected to base plate 41 with another solenoid control valve 45 being mounted therein for controlling the flow of fluid to fuel spray bar 46 spaced with respect to nitrous oxide spray bar 43 in a usual manner.

A nitrous oxide pickup tube 48 extends from adjacent the bottom of cylinder 2 upwardly through the cylinder and is connected to valve 32 at its lower end by a coupler 49 (FIG. 2). Tube 48 extends through axial bore portion 20 and a bore 50 of threaded bottom end 12. Tube 48 has a smaller diameter than that of bore portions 20 and 50 so as to form an annular space 51 between tube 48 and the interior walls of adapter 10 which form axial bore 18. Likewise, coupler 49 which is attached to the upper end of pickup tube 48 has a diameter smaller than that of center bore portion 19 so as to form an annular space 52 adjacent transverse secondary bores 21 and 22.

A preferred example of the operation of improved fuel charging system 1 is set forth below. However, the invention need not be limited to the particular pressures given in the following example since the same may change without affecting the concept of the invention. Cylinder 2 has a supply of liquid nitrous oxide 54 (FIG. 1) pressurized at an initial pressure of approximately 900 psi. Valve 32 will be in open position with solenoid valve 42 in a closed position. Likewise, pressure relief valve 25 will be closed having a preset opening position at approximately 950 psi.

Cylinder 3 will contain a supply of nitrogen gas under a pressure of approximately 3000 psi. Regulator valve 6 will have an output pressure of 900 psi generally equal to the initial pressure of the nitrous oxide in cylinder 2. Valve 4 by means of manually operated handle 5 will be in an open position enabling nitrogen gas to flow through regulator valve 6 and into cylinder 2. The incoming nitrogen gas flows through secondary bore 21 and through annular spaces 51 and 52 along the exterior of delivery tube 48 and into an upper void portion 55 of cylinder 2. This nitrogen gas forms a pressurized blanket of the gas above liquid nitrous oxide 54 as shown by arrows A in FIG. 1 which will force the nitrous oxide up through delivery tube 48 and into delivery line 39.

The improved fuel charging system will maintain this pressurized blanket of nitrogen condition until the driver wishes to supply the sudden burst of power to the vehicle engine. The operator will actuate a control button located within the driving compartment (not shown) which will actuate solenoid valves 42 and 45 permitting a flow of nitrous oxide and fuel into the carburetor through spray bars 43 and 46 respectively. The pressurized nitrogen gas will maintain liquid nitrous oxide flowing through line 39 at the preset pressure of 900 psi until the nitrous oxide is depleted from cylinder 2. This constant pressure is maintained due to the continued regulated pressure of the nitrogen gas blanket forcing against the nitrous oxide in cylinder 2 regardless of the volume therein since a constant supply of high pressure nitrogen gas is supplied from cylinder 3 into cylinder 2.

Adapter 10 enables the nitrogen gas to enter the interior of cylinder 2 through the top opening while permitting the simultaneous flow of nitrous oxide therethrough in an opposite direction and into delivery conduit 39. Thus a driver is able to maintain maximum performance and efficiency from the improved fuel charging system since the nitrous oxide is supplied under the predetermined regulated pressure throughout the charging duration regardless of the amount of nitrous oxide remaining in cylinder 2. This ensures the most efficient mixture of nitrous oxide with the predetermined amount of incoming fuel through conduit 44. With this arrangement an additional several seconds more of sustained high efficient fuel charging will be obtained than heretofore possible providing the additional boost of power to the racing vehicle. This sustained boost of power even though only several seconds in duration will provide the necessary competitive advantage in many races to achieve victory or better performance from the racing vehicle. The nitrogen gas will not appreciably mix with the nitrous oxide and, therefore, will enable this pressure blanket of gas to be maintained in constant contact with the liquid nitrous oxide for discharging the same from the supply cylinder and into the vehicle engine.

Accordingly, the improved fuel charging system provides for an increased duration of maximum efficiency of chemically supercharging a high preformance vehicle without appreciably increasing the weight of the system, and which enables the heretofore used size of nitrous oxide supply cylinders to be maintained. This is achieved by using a smaller and lighter weight nitrogen gas cylinder connected to the nitrous oxide cylinder through an improved adapter permitting the formation of the pressurized nitrogen gas blanket against the nitrous oxide simultaneously with the passage of the nitrous oxide through a delivery tube through the adapter and into the spray bar of the charging system. Due to the higher pressure under which the nitrogen gas can be maintained in cylinder 3 in contrast to the pressure of the nitrous oxide in cylinder 2, all of the nitrous oxide can be discharged from cylinder 2 before depletion of the nitrogen gas or reduction of the pressure on the outlet side of regulator 6.

In the event of any malfunction, relief valve 25 will open and permit the discharge of the pressurized nitrous oxide through annular spaces 51 and 52, secondary bore 22 and drain line 27. This increases the safety of the system and prevents any possible malfunction of the charging system which could injure the vehicle driver. The nitrous oxide will be discharged harmlessly out of the vehicle through overboard drain 28 which wlll be located exterior of the vehicle. Pressure relief valve 36 which is incorporated into main valve 32 provides a further safety backup device for charging system 1.

Accordingly, the improved fuel charging system is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved fuel charging system for high performance vehicles is constructed and used, the characteristics of the construction, and the advantageous, new and useful results obtained; the new and useful structures, devices, elements, arrangements, parts, and combinations, are set forth in the appended claims.

What is claimed is:

1. A fuel charging system for the engine of a high performance vehicle including:

(a) a first container for holding a supply of pressurized liquid nitrous oxide;

(b) a second container for holding a supply of pressurized nitrogen gas, said nitrogen gas being under a greater pressure than the nitrous oxide;

(c) first conduit means for delivering nitrous oxide from the first container to the vehicle engine;

(d) second conduit means for delivering pressurized nitrogen gas from the second container into the first container to form a pressurized blanket of nitrogen gas against the liquid nitrous oxide for discharging the nitrous oxide from said first container and into the vehicle engine through the first conduit means; and (e) valve means for directing the flow of pressurized nitrogen gas into the first container to form the pressurized blanket of nitrogen gas and for permitting the flow of nitrous oxide from said container and into the first conduit means.

2. The fuel charging system defined in claim 1 in which the pressurized nitrous oxide is under a pressure of approximately 900 psi.

3. The fuel charging system defined in claim 1 in which the pressurized nitrogen gas is at a pressure of approximately 3000 psi in the second container.

4. The fuel charging system defined in claim 1 in which a pressure regulator valve is in the second conduit means to maintain a predetermined nitrogen gas pressure on the nitrous oxide in the first container.

5. The fuel charging system defined in claim 1 in which the valve means includes an adapter having a body formed with a main axial bore and a secondary transversely extending nitrogen gas inlet bore communicating with said main bore; in which a nitrous oxide pickup tube extends through the main axial bore and terminates adjacent the bottom of the first container, said pickup tube being sufficiently smaller in diameter than the axial bore to form an annular space within the main axial bore about the tube for passage of the nitrogen gas from the nitrogen gas inlet bore into the first container for forming the high pressure blanket of nitrogen gas above the nitrous oxide to force said nitrous oxide through the pickup tube and first conduit means and into the vehicle engine.

6. The fuel charging system defined in claim 5 in which the first container includes a top opening; in which the adapter body is secured in the container top opening; in which the valve means further includes a manually actuated valve mounted on the adapter; and in which the nitrous oxide pickup tube and the first conduit are connected to the adapter with said manual valve controlling the flow of nitrous oxide from the pickup tube into the first conduit.

7. The fuel charging system defined in claim 6 in which a second transverse bore is formed in the adapter body and communicates with the main bore; and in which a pressure relief valve is mounted in said second transverse bore and has a release setting higher than the pressure of the nitrogen gas exerted on the nitrous oxide.

8. The fuel charging system defined in claim 7 in which the relief valve is set for approximately 950 psi.

9. The fuel charging system defined in claim 7 in which the adapter body has a generally cylindrical configuration with an externally threaded end for securing the adapter body in the top opening of the first container, and an opposite internally threaded end for mounting of the manual control valve therein.

10. The fuel charging system defined in claim 9 in which the main axial bore has a first cylindrical section which communicates with the transverse secondary bore, and has a smaller diameter second cylindrical section through which the nitrous oxide pickup tube extends.

11. The fuel charging system defined in claim 4 in which the pressure regulator valve maintains the nitrogen gas pressure at approximately 900 psi in the first container.

12. The fuel charging system defined in claim 4 in which a manual control valve is mounted on the second container for manually controlling the flow of nitrogen gas into the second conduit means.

13. The fuel charging system defined in claim 1 in which a remotely controlled solenoid valve is mounted in the first conduit means.

* * * * *